US006663497B2

(12) United States Patent
Cameron

(10) Patent No.: US 6,663,497 B2
(45) Date of Patent: Dec. 16, 2003

(54) ADJUSTABLE PUTTER

(75) Inventor: Donald T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/051,007

(22) Filed: Jan. 22, 2002

(65) Prior Publication Data

US 2002/0107086 A1 Aug. 8, 2002

Related U.S. Application Data

(60) Provisional application No. 60/263,709, filed on Jan. 25, 2001.

(51) Int. Cl.[7] ..... A63B 53/06

(52) U.S. Cl. ..... 473/245; 473/313; 473/255; 473/340

(58) Field of Search ..... 473/255, 340, 473/251, 349, 345, 313, 245

(56) References Cited

U.S. PATENT DOCUMENTS

| | | | | | |
|---|---|---|---|---|---|
| 749,174 | A | | 1/1904 | Davis | |
| 1,665,523 | A | | 4/1928 | Boyce | |
| 1,818,359 | A | | 8/1931 | Samaras et al. | |
| 2,026,749 | A | | 1/1936 | Pester | |
| 2,138,294 | A | | 11/1938 | Douglas | |
| 2,175,598 | A | | 10/1939 | Fedak | |
| 2,305,270 | A | | 12/1942 | Nilson | |
| 2,451,262 | A | | 12/1948 | Watkins | |
| 3,477,720 | A | | 11/1969 | Saba | |
| 3,888,492 | A | * | 6/1975 | Cabot | 473/255 |
| 4,067,572 | A | * | 1/1978 | Coleman | 473/245 |
| 4,194,739 | A | * | 3/1980 | Thompson | 473/241 |
| 4,778,180 | A | | 10/1988 | Guenther | |
| 5,072,941 | A | * | 12/1991 | Klein | 473/255 |
| 5,230,509 | A | | 7/1993 | Chavez | |
| 5,244,205 | A | | 9/1993 | Melanson et al. | |
| 5,275,413 | A | | 1/1994 | Sprague | |
| 5,390,920 | A | | 2/1995 | Nickum | |
| 5,431,337 | A | | 7/1995 | Bell | |
| 5,437,447 | A | * | 8/1995 | Rigutto | 473/251 |
| 5,470,070 | A | | 11/1995 | Bendo | |
| 5,529,302 | A | | 6/1996 | Rodriguez | |
| 5,544,897 | A | | 8/1996 | Di Pietro et al. | 277/389 |
| 5,577,726 | A | | 11/1996 | Fenton | |
| 5,580,058 | A | | 12/1996 | Coughlin | |
| 5,700,207 | A | | 12/1997 | Guthrie et al. | |
| 5,709,613 | A | | 1/1998 | Sheraw | |
| 5,749,790 | A | | 5/1998 | Van Alen, II et al. | 473/245 |
| 5,785,608 | A | | 7/1998 | Collins | 473/313 |
| 5,863,257 | A | | 1/1999 | Busnardo | |
| 5,890,969 | A | * | 4/1999 | Bechler | 473/255 |
| 6,045,453 | A | | 4/2000 | Jenkins | |
| 6,203,446 | B1 | | 3/2001 | Collins | 473/313 |
| 6,506,125 | B2 | | 1/2003 | Helmstetter et al. | 473/242 |
| D477,041 | S | | 7/2003 | Cameron | D21/742 |

FOREIGN PATENT DOCUMENTS

| | | |
|---|---|---|
| JP | 08-266695 | 10/1996 |
| JP | 09-000667 | 1/1997 |
| JP | 09-220302 | 8/1997 |

* cited by examiner

*Primary Examiner*—Paul T. Sewell
*Assistant Examiner*—Tom P Duong
(74) *Attorney, Agent, or Firm*—Swidler Berlin Shereff Friedman, LLP

(57) ABSTRACT

A golf putter head adapted for attachment to a club shaft is provided with a face member having a strike face and a cylindrical back cavity, and a body member configured to fit and rotate within the back cavity. Selective rotation of the body member within the back cavity sets a loft of the putter head. The weighting of the putter is adjusted by securing a weight member to the body member.

13 Claims, 5 Drawing Sheets

ADJUSTABLE PUTTER

This application claims the benefit of provisional application No. 60/263,709 filed on Jan. 25, 2001.

FIELD OF THE INVENTION

The invention relates to an adjustable golf club construction. More particularly, the invention is related to a putter with adjustable loft and weighting.

BACKGROUND OF THE INVENTION

The design of putters is typically viewed as a pursuit of an aesthetically pleasing club that promotes a golfer's confidence in his or her stroke. As such, many putters have been designed irrespective of the mechanics inherent in the putting swing. Furthermore, many putters lack a design that accounts for an individual golfer's characteristics and characteristic playing style (i.e., stance, grip, etc.).

The lack of attention to technical details in many putter designs results in clubs that are not aimed or balanced properly. Such technical considerations, for example, include heel and toe weight distribution, location of the putter head's center of gravity or "sweet spot," putter length, shaft flexibility, grip, head weight and total club weight, loft, and lie. Because the USGA Rules of Golf permit significant latitude in the design of putters, i.e., the shaft, neck or socket of a putter may be fixed at any point in the head, many putter designs are possible. And, because significant deviation in the intended path of a putt can be experienced for even slightly off-center hits, careful attention to these design factors can result in a putter that is more likely to perform well in use. Moreover, an adjustable putter design may permit the variation of one or more of the aforementioned design considerations to more closely suit the needs of a given user.

Various adjustable club constructions are known. For example, U.S. Pat. No. 2,305,270 to Nilson discloses a golf club with a hosel that has an extension on which the head is slidably and pivotally mounted. The extension is embedded in a shallow depression in the back of the head and runs substantially the entire length of the head. The head further includes lugs with inner serrated portions, and when a desired angle has been selected for the face, serrated portions on the extension are engaged with the lugs to lock the position.

U.S. Pat. No. 4,778,180 to Guenther discloses a golf club having a reversible head for use either as a putter or chipper, and for use by either a left handed or right handed player. In operation, the head is rotatable by 180° on a pin to present either a chipper face or putter face. A lever with side cam surfaces permits releasable locking of the head in position.

U.S. Pat. No. 4,194,739 to Thompson discloses an adjustable golf putter with a body and a separate putter face that is initially adjustable relative to the body prior to permanent securement. The putter includes an elongated tapered body having a plane of symmetry extending in the direction of the putting motion. The face is rotatably mounted on the head about a pin, and a pair of screws secure the face to prevent rotation. A bubble level is also recessed in the putter face. If the putter face is not level, the golfer loosens the screws, pivots the putter face about the pin to adjust the angle between the upper surface of the putter face and the shaft, and when the bubble level indicates level for the preferred putting stance of the golfer, the screws are tightened. The weight of the putter head is adjustable by disposing cylindrical weight inserts in a bore in the body located behind and perpendicular to the face.

In addition, U.S. Pat. No. 4,067,572 to Coleman discloses a golf club with a hollow main body, thereby providing a chamber into which liquid or granular weighting material may be placed. The main body is preferably spherical, and a movable, disc-shaped face portion is provided on its rear with a portion that is contoured to complement the spherical shape of the body. A clamping member and retaining bolt are provided; loosening the bolt permits the club face portion to be repositioned through an arc of 360°, while tightening the bolt fixes the face portion in the desired position.

Despite these developments, there exists a need for an improved putter construction. In particular, there is a need for an improved putter with adjustable loft and weighting.

SUMMARY OF THE INVENTION

The present invention is related to a golf putter head adapted for attachment to a club shaft. The head includes a face member having a strike face and a cylindrical back cavity, and a body member configured to fit and rotate in at least one plane or direction within the back cavity. Selective rotation of the body member within the back cavity sets a loft of the putter head. In one embodiment, a weight member is coupled to the body member, and is symmetrically disposed about a longitudinal center of the body member. The weight member may have a generally arcuate shape and may be disposed on the back portion of the body member.

The back cavity of the face member may include two recessed wing portions and a recessed generally cylindrical portion disposed therebetween, while the body member may include a front portion with a generally cylindrical projecting portion and a cylindrical passage extending parallel therethrough. The front portion of the body member further includes opposing sections separated by a slit that extends along the length of the cylindrical passage, the opposing sections being connected by a threaded hole. Threadable engagement of a fastener in the threaded hole changes the separation of the opposing sections.

A generally cylindrical insert is configured and dimensioned to be received within the cylindrical passage of the body-member, with the insert further including a base portion configured to be received in fixed orientation within the wing portions.

The body member may be generally rectangular and have a side flange with a bore therein, the bore being configured and dimensioned to receive the shaft. The body member also may include a front portion, a back portion, and a pair of sides, the sides each having a lower edge with at least two edge portions that are crooked with respect to each other at an angle of between about 0° and about 30°.

The present invention is further related to a golf putter head adapted for attachment to a club shaft. The putter head includes a face member having a strike face and a back cavity, the back cavity including at least one keyway portion, and a body member configured to fit and rotate in at least one plane or direction within the back cavity, the body member including a passage therein. In addition, the putter head includes an insert configured to fit and rotate in at least one plane or direction within the passage, the insert including at least one keyed portion. When the keyed portion is disposed in the keyway portion, selective rotation of the body member about the insert sets a loft of the putter head.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
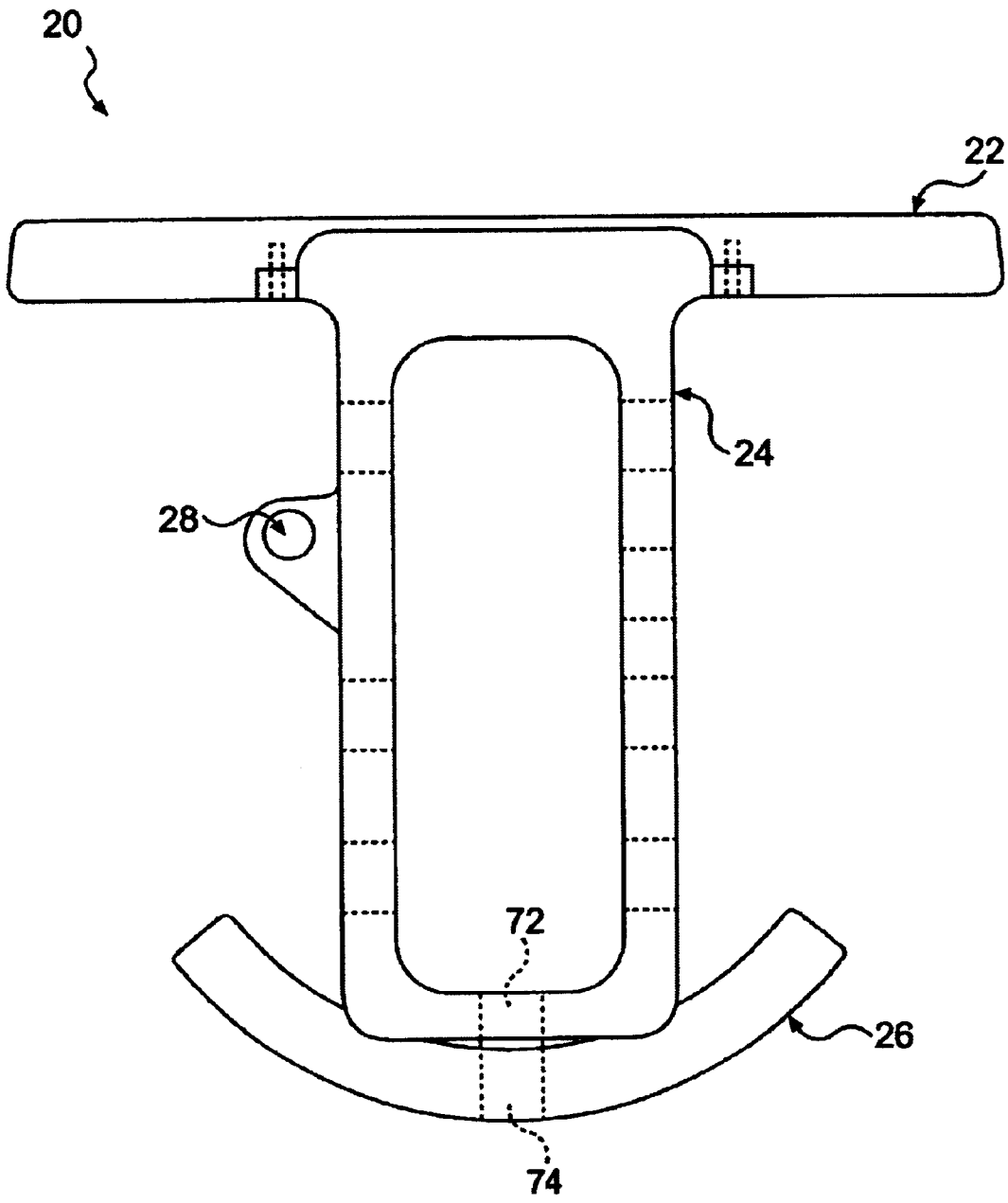
FIG. 1 shows a top view of a putter head according to the present invention with back weighting.

Referring to FIGS. 1–10, the putter construction according to the present development is shown. Putter head 20 includes a face member 22, a body member 24, and a back weight member 26, each of which are secured together as will be discussed. A shaft bore 28 is provided for attachment of putter head 20 to a club shaft.

Figure 2:
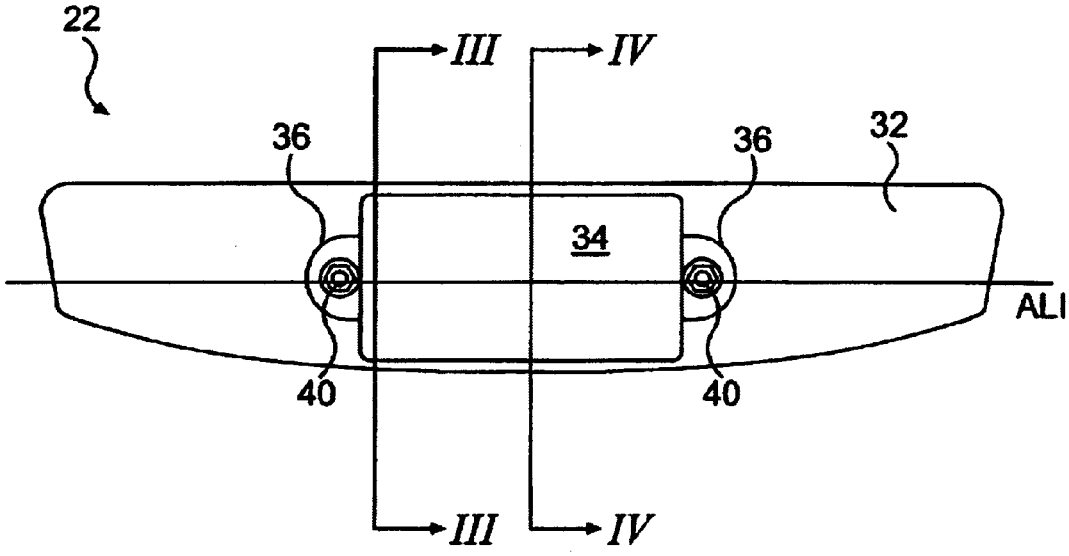
FIG. 2 shows a back view of a face member for a putter head according to the present invention with a cavity therein.
Figure 3:
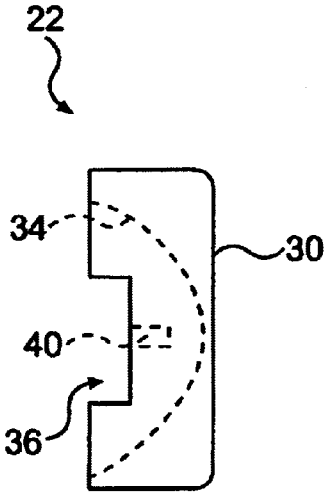
FIG. 3 shows a cross-section of the face member of FIG. 2 taken along line III—III.
Figure 4:
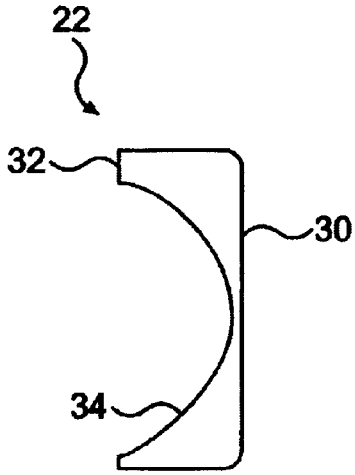
FIG. 4 shows a cross-section of the face member of FIG. 2 taken along line IV—IV.

As shown in FIGS. 2–4, face member 22 has a generally flat ball-striking front portion 30 and a back portion 32. A recessed region or back cavity 34 is formed in back portion 32, and preferably has a generally cylindrical contour. A pair of recessed wing portions 36 are formed at opposite ends of back cavity 34, creating a keyway that preferably has a depth less than the maximum depth of back cavity 34. A hole 40 is formed in each wing portion 36 for receiving a threaded fastener. Preferably, back cavity 34 is substantially symmetric about line ALI, which is also generally parallel to the ground.

Figure 5:
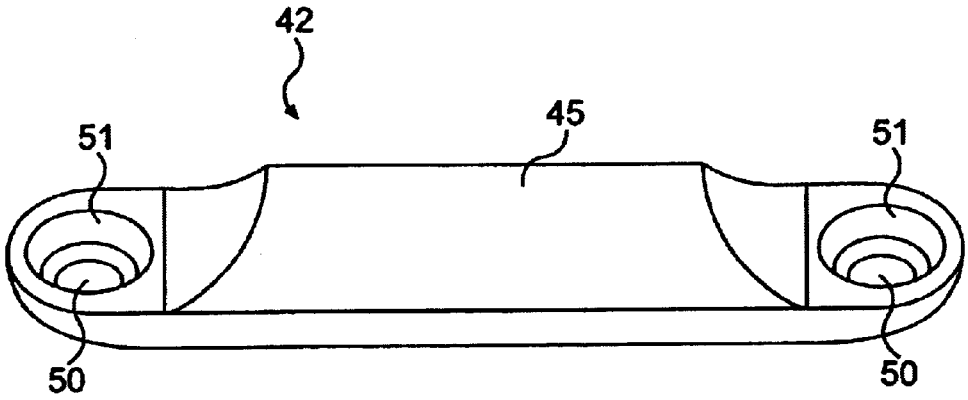
FIG. 5 shows a bottom, perspective view of an insert member for a putter head according to the present invention.
Figure 6:
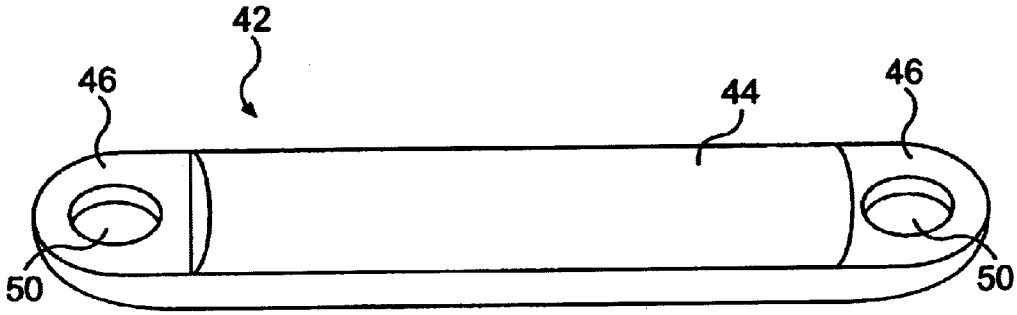
FIG. 6 shows a top, perspective view of the insert member of FIG. 5.
Figure 7:
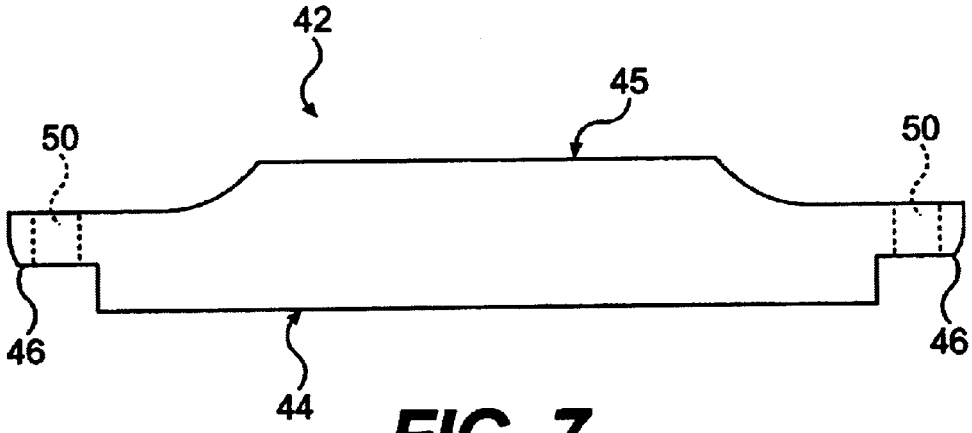
FIG. 7 shows a side view of the insert member of FIG. 5.

Turning to FIGS. 5–6, in one embodiment of the present invention, an insert 42 is provided for coupling body member 24 to face member 22. Insert 42 includes a central, generally cylindrical projecting portion 44, along with a base portion 46 which creates a keyed portion that is adapted to be received within wing portions 36 of back cavity 34 of face member 22. A generally cylindrical, tapered portion 45 is also provided, and serves as a further keyed region for aiding in insertion of insert member 42 into body member 24. More particularly, the overall longitudinal geometry of insert 42 is cylindrical, such that it can rotate in at least one plane or direction within body member 24 as will be described shortly. Base portion 46 includes a pair of holes 50, which preferably include recessed portions 51 so that the head of a screw or other fastener may be recessed therein.

The loft of the putter is defined as the angle of the face and a line perpendicular to the sole line measured to a point that is half of the distance of the face height and located on the center of the face. In order to provide adjustment of the loft, the angle of body member 24 related to face member 22 is adjusted by rotation within cylindrical back cavity 34 of face member 22. With an insert member 42 disposed in body member 24, and with base portion 46 disposed within wing portions 36, the loft may be changed to a suitable amount.

Figure 8:
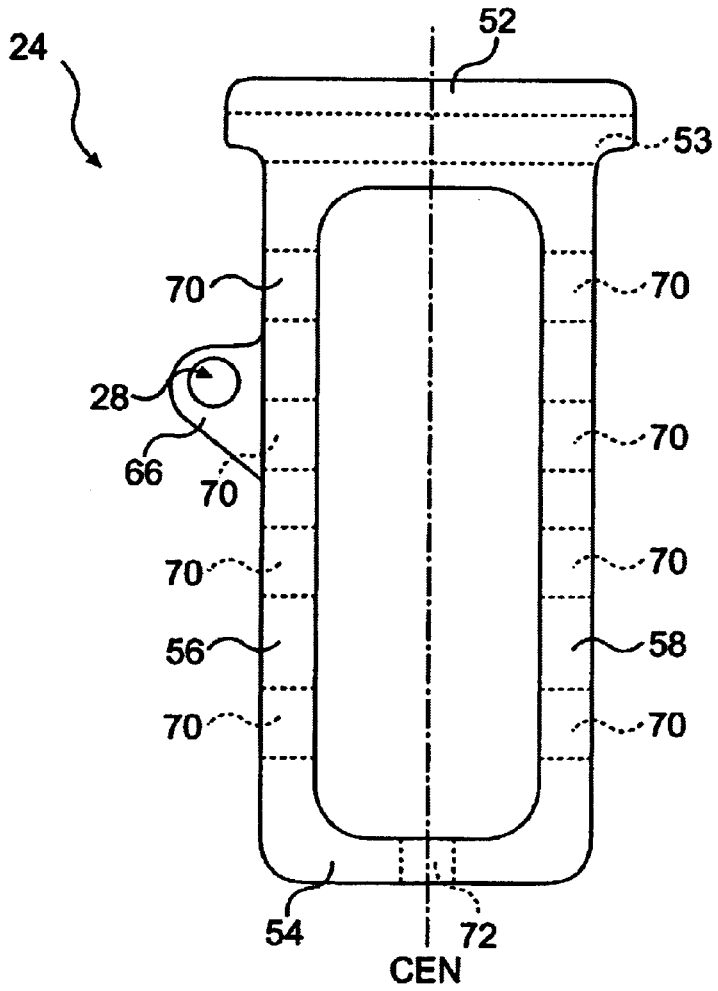
FIG. 8 shows a top view of a body member for a putter head according to the present invention.
Figure 9:
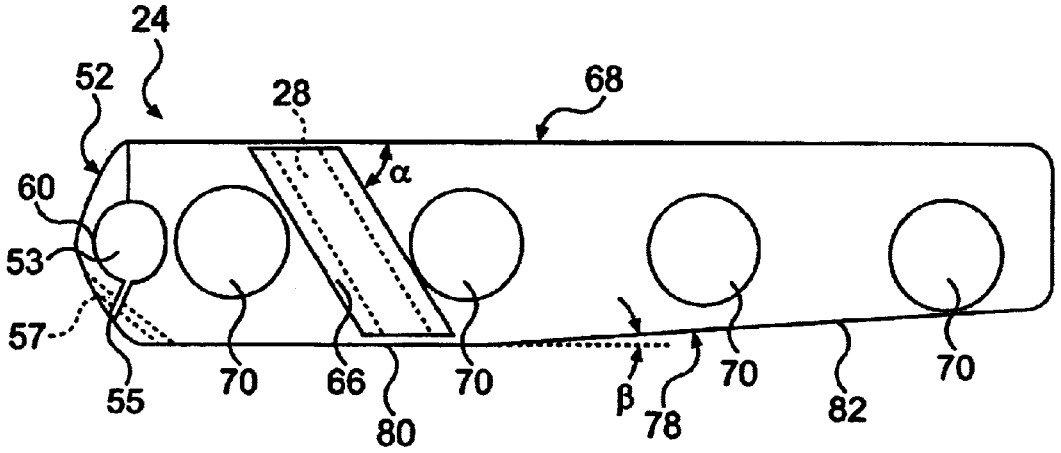
FIG. 9 shows a side view of the body member of FIG. 8.
Figure 10:
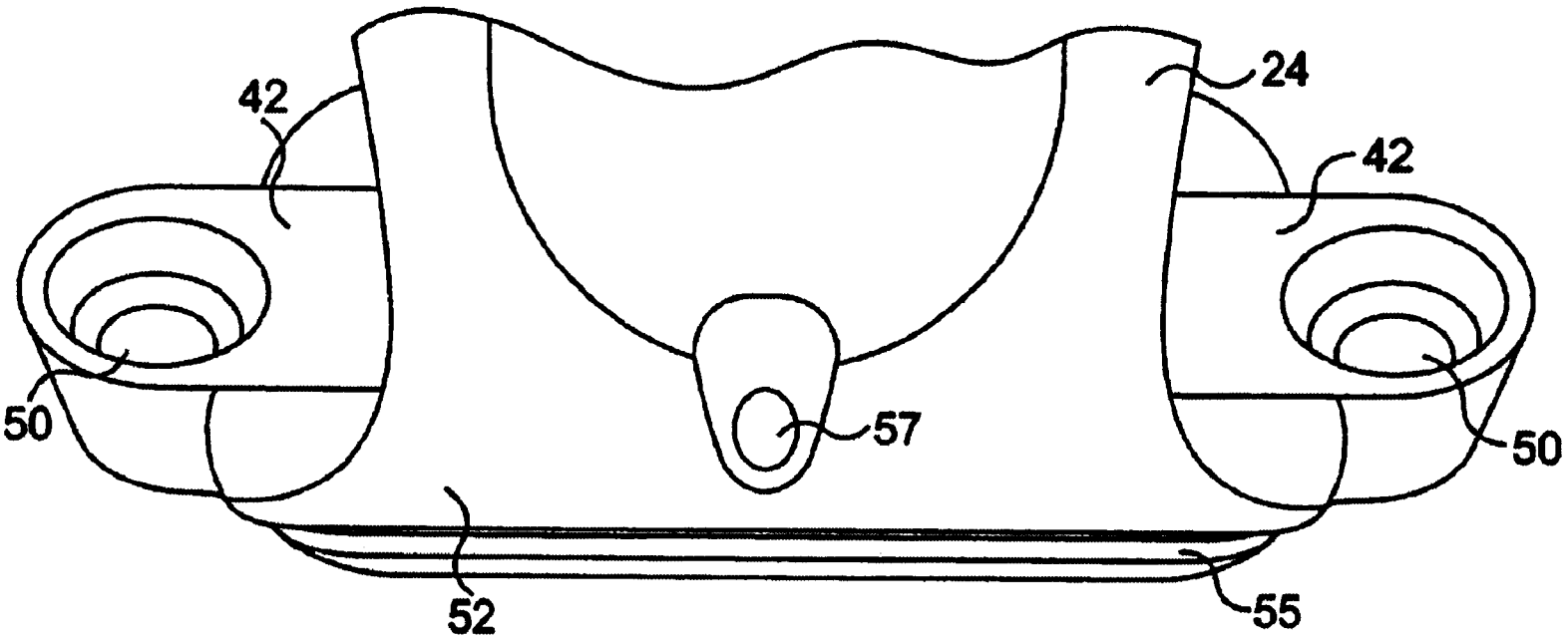
FIG. 10 shows a partial perspective view of the body member according to the present invention with an insert member housed therein.

More particularly, with reference to FIGS. 8–10, body member 24 is generally rectangular and hollow, and includes cylindrical front portion 52, back portion 54, and side portions 56, 58. Front portion 52 receives an insert member 42 in cylindrical passage 53. Front portion 52 further includes a slit 55 extending along the length of cylindrical passage 53, and thus providing a loose fit of insert member 42 when placed in cylindrical passage 53, which runs parallel to line ALI when front portion 52 contacts back cavity 34. During setting of the desired loft, body member 24, with an insert member 42 housed in passage 53, is loosely coupled to face member 22. With the insert member 42 resting in wing portions 36, the body member 24 may be rotated with respect to face member 22; the body member rotates about insert member 42, which is fixed in location and angle with respect to face member 22. When a desired loft has been set, the insert member 42 may be tightly coupled to face member 22 using screws or other fasteners, which extend through holes 50, 40 in insert member 42 and face member 22, respectively. In addition, the rotation of body member 24 with respect to insert member 42 may be arrested through the use of a threaded fastener that extends through threaded hole 57 and connects opposing portions of front portion 52 separated by slit 55. When the fastener is tightened, the separation between these portions may be decreased such that the gap provided by slit 55 is closed. In turn, the diameter of passage 53 is slightly decreased, locking insert member 42 in place.

A side flange 66 is provided on a side 56, 58, depending on whether the golfer is right-handed or left-handed. A shaft bore 28 for receiving a club shaft extends at least partway through flange 66, which is oriented at an angle $\alpha$ with respect to a flat edge 68 of body member 24. Preferably, angle $\alpha$ is between about 5° and about 85°. The desired loft may be set by rotating body member 24 with respect to face member 22.

As shown in FIG. 9, edge 68 is disposed opposite an edge 78 of body member 24. Edge 78 includes straight potions 80, 82 which are crooked with respect to each other. Preferably, straight potions 80, 82 are disposed at an angle $\beta$ between about 0° and about 30°.

Body member 24 also includes bores 70 through side walls 56, 58. Weight removed from side walls 56, 58 due to the presence of bores 70 may be redistributed in putter head 20, such as with back weight member 26 as shown in FIG. 1. Further to this end, a hole 72 is provided in back portion 54 of body member 24 so that back weight member 26 with a similarly disposed hole 74 may be secured thereto, as with a fastener such as a screw. More than one hole 74 may be provided so that several fasteners may be used. Preferably, back weight member 26 is generally arcuate in shape, and is symmetrically disposed with respect to line CEN along the longitudinal center of body member 24. Back weight member 26 may farther include a central recessed region, so as to conform to the geometry of body member 24.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, in an alternate embodiment, the mating portions of face member 22 and body member 24 may include a series of facets along a generally cylindrical shape, instead of smooth cylindrical surfaces. Such facets may provided a more positive engagement of the components during fitting. In addition, in another embodiment, body member 24 may be secured to face member 22 without an insert member 42. Front portion 52 of body member 24 may be provided with projections that mate with wing portions 36 in face member 22. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A golf putter head adapted for attachment to a club shaft comprising:

a face member having a strike face and a cylindrical back cavity;

a body member configured to fit and rotate in at least one plane or direction within the back cavity, the body member including a front portion with a generally cylindrical projecting portion and a cylindrical passage extending parallel thereto;

a weight member coupled to the body member; and a generally cylindrical insert configured and dimensioned to be received within the cylindrical passage, the insert further including a bas portion fixedly coupled to the face member;

wherein selective rotation of the body member within the back cavity sets a loft of the putter head.

2. The putter head of claim 1, wherein the weight member is symmetrically disposed about a longitudinal center of the body member.

3. The putter head of claim 2, wherein the weight member has a generally arcuate shape and is disposed on a back portion of the body member.

4. The putter head of claim 1, wherein the body member further comprises a side flange with a bore therein, the bore being configured and dimensioned to receive the shaft.

5. The putter head of claim 1, wherein the body member comprises a front portion, a back portion, and a pair of sides, the sides each having a lower edge with at least two edge portions that are crooked it respect to each other.

6. The puffer head of claim 5, wherein the edge portions are crooked at an angle of between about 0° and about 30°.

7. The putter head of claim 1, wherein the weight member includes a central recessed portion.

8. A golf putter head adapt d for attachment to a club shaft comprising:

a face member having a strike face and a cylindrical back cavity, the back cavity comprising two recessed wing portions and a recessed generally cylindrical portion disposed therebetween;

a body member configured to fit and rotate in at least one plane or direction within the back cavity, the body member including a front portion with a generally cylindrical projecting portion and a cylindrical passage extending parallel thereto; and a generally cylindrical insert configured and dimensioned to be received within the cylindrical passage, the insert further including a base portion configured to be received in fixed orientation within the wing portions;

wherein selective rotation of the body member within the back cavity sets a loft of the putter head.

9. The putter head of claim 8, wherein the front portion further includes opposing sections separated by a slit that extends along the length of the cylindrical passage, the opposing sections being connected by a threaded hole.

10. The putter bead of claim 9, wherein threadable engagement of a fastener in the threaded hole changes the separation of the opposing sections.

11. A golf putter head adapted for attachment to a club shaft comprising:

a face member having a strike face and a back cavity, the back cavity including at least one keyway portion;

a body member configured to fit and rotate in at least one plane or direction within the back cavity, the body member including a passage therein; and an insert configured to fit and rotate within the passage, the insert including at least one keyed portion, wherein when the keyed portion is disposed in the keyway portion, selective rotation of the body member about the insert sets a loft of the putter head.

12. A golf putter head adapt d for attachment to a club shaft, comprising:

a body member having a front portion with a generally cylindrical projecting portion and a cylindrical passage extending parallel thereto;

a face member adjustably coupled to the body member, the face member having a strike face and a cylindrical back cavity configured to fit over and rotate about the projecting portion;

a weight member fixedly coupled to the body member, the weight member being symmetrically disposed about the body member.

a generally cylindrical insert configured and dimensioned to be received within the cylindrical passage and having a base portion fixedly coupled to the face member.

13. The golf putter head of claim 12, wherein:

the front portion includes opposing sections separated by a slit that extends along the length of the cylindrical passage, the opposing sections being connected by a threaded hole;

threadable engagement of a fastener in the threaded hole changes the separation of the opposing sections.

* * * * *